United States Patent [19]

Schellenberg et al.

[11] 4,291,529

[45] Sep. 29, 1981

[54] FALSE TWIST MACHINE

[75] Inventors: Hans Schellenberg, Winterthur; Eduard Schenkel; Andreas Schwander, both of Seuzach; Dieter Thalmann, Winterthur, all of Switzerland

[73] Assignee: Rieter Machine Works, Ltd., Winterthur, Switzerland

[21] Appl. No.: 109,663

[22] Filed: Jan. 4, 1980

Related U.S. Application Data

[62] Division of Ser. No. 935,110, Aug. 21, 1978, Pat. No. 4,201,036.

[30] Foreign Application Priority Data

Mar. 1, 1978 [CH] Switzerland ..... 2195/78

[51] Int. Cl.[3] ..... D02G 1/02; D01H 13/28

[52] U.S. Cl. ..... 57/291; 57/352

[58] Field of Search ..... 57/282, 284, 287, 288, 57/290, 291, 308, 352; 242/35.5 R, 35.5 A, 131, 131.1

[56] References Cited

U.S. PATENT DOCUMENTS

| | | | |
|---|---|---|---|
| 3,165,881 | 1/1965 | Moncuit et al. | 57/291 |
| 3,289,400 | 12/1966 | Scragg | 57/290 |
| 3,501,904 | 3/1970 | Batsch | 57/290 |
| 3,559,255 | 2/1971 | Cockroft | 57/280 X |
| 3,916,609 | 11/1975 | Yamada et al. | 57/291 |
| 3,942,312 | 3/1976 | Venot | 57/291 X |
| 3,946,546 | 3/1976 | Venot | 57/291 X |
| 3,962,829 | 6/1976 | Schippers | 57/291 |
| 3,987,974 | 10/1976 | Mayer | 242/35.5 A |
| 4,015,786 | 4/1977 | Slavik et al. | 242/35.5 A |
| 4,024,697 | 5/1977 | Bücher et al. | 57/290 |
| 4,051,650 | 10/1977 | Gleyze et al. | 57/291 |
| 4,065,073 | 12/1977 | Rohner | 242/131 |

FOREIGN PATENT DOCUMENTS

| | | |
|---|---|---|
| 52-128747 | 9/1977 | Japan . |
| 1558108 | 12/1979 | United Kingdom . |

*Primary Examiner*—Donald Watkins
*Attorney, Agent, or Firm*—Kenyon & Kenyon

[57] ABSTRACT

The false twist machine has a texturing part arranged below heat treatment zones in which three supply devices and a false twist device are superimposed and staggered from the back to the front in such a manner that in threading in of the thread into these devices turning about and overhead working processes of the operator are avoided. The thread paths formed by the threading in are placed one in front of the other in the sequence of the threading in process. A bobbin creel is movable to the texturing part and is equipped with a thread transfer device which transfers the threads coming from the individual creel bobbins into the vicinity of the first supply device. The winding device is arranged opposite the texturing part at a distance forming an operating alley and gives off the full bobbins to the outerside of the winding device opposite the operating alley. The empty bobbins can be moved from the machine end into a readiness reserve position.

3 Claims, 6 Drawing Figures

20
21
22
26
1
19
23
18
25
24

35
26
20
19
35
26
1
35
26
35
26
32

FALSE TWIST MACHINE

This is a division, of application Ser. No. 935,110 filed Aug. 21, 1978 now U.S. Pat. No. 4,201,036, issued May 6, 1980.

This invention relates to a false twist machine. As is known, false twist machines produce texturised yarns of rather fine denier (titres), e.g. ranging from 15 to 300 dtex, at speeds in the range of 800 meters per minute and higher.

It is known from practice that, on the other hand, handling threads of fine denier (titres) on a false twist machine requires high standards of care by the operator and, on the other hand, that thread breakages, during the production process cannot be completely avoided. Hence, the following operative requirements are to be coordinated in the construction of false twist machines:

(a) Easy to operate exchange of the creel bobbins without interrupting production, and good accessibility for piecing the thread end of a creeled bobbin to the thread front end on a full creel bobbin placed in reserve.

(b) Good accessibility for transferring the thread from the creeled bobbin and threading in the thread on all further elements to the winding device without interruption, i.e. with a single suction gun sucking in the thread without interruption until the thread is transferred to the winding device.

(c) Operation of as many false twist units, or texturising units as the case may be, by a single operator.

False twist machines are known, on which the creels, the winding devices, the supply devices and the false twist device are arranged substantially at a high level operable from an operating alley.

For example, British Pat. No. 1,199,071, describes a false twist machine in which a bobbin creel is arranged below a winding device on one side of an operating alley. A pair of supply devices, a false twist device and a cooling zone arranged between the supply devices, as well as a heat treatment zone arranged vertically in between are provided on the other side of the operating alley. In this known arrangement, the thread path from the bobbin creel to the first supply device is located below a walking floor arranged in the operating alley. The thread is transported from the second supply device through a second heat treatment zone, which forms an upper connection between the two operating sides, to a third supply device, and from there to a corresponding winding device.

A substantial disadvantage of this known arrangement is that the false twist device and the cooling zone are arranged above the first heat treatment zone. Furthermore, operating the winding device in the upper region of the operating zone is not sufficiently easy. Moreover, the operator is required to turn around twice and to perform overhead operation during the threading in of the thread.

Another false twist machine, is described in U.S. Pat. No. 4,051,650. In this machine, a bobbin creel, and a winding device are arranged on opposite sides of an operating alley. A second heat treatment zone is arranged behind the winding device, as viewed from the operating alley. Second and third supply arrangements are respectively located above and below the second heat treatment zone. A first supply device is arranged above the operating alley, and a first heat treatment zone is arranged above the bobbin creel, extending under at an angle from top to bottom towards the center. The thread path forms two deflections between the bobbin creel and the false twist device located above the winding device. The first deflection is formed in the first supply device, and the second deflection is formed using a J-shaped supply tube in the first heat treatment zone.

Disadvantages of this arrangement lie essentially in the fact that the thread path changes direction several times between the bobbin creel and the false twist device since the heat treatment zone is arranged behind the winding device, and in a difficult operation due to the high location of the first and second supply devices and due to the arrangement of the false twist device and of the cooling zone above the first heat treatment zone.

U.K. Pat. No. 1,497,245 (U.S. Pat. No. 4,024,697) describes a false twist machine in which a bobbin creel and a multiple-tiered winding device are arranged back to back. The operating side of the winding device is arranged at a distance from the cooling zone to form an operating alley, as well as from the false twist device. A first and a third supply device are arranged above the operating alley but below a horizontal plane determined by the upper side of the bobbin creel. Above this plane and above the cooling zone, two heat treatment zones are provided. The thread path extends from the operating side of the bobbin creel via deflecting rollers and via the upper side of the bobbin creel into the first supply device and on via the first heat treatment zone. Subsequently, the thread path extends downward through the cooling zone, into the false twist device and into the second supply device, and from there upward through the second heat treatment zone and then downward into the third supply device, and finally, across the operating alley, into the winding device.

Substantial disadvantages of this false twist machine are that for threading the thread into the first supply device, the thread has to be guided from the operating side of the bobbin creel above the bobbin creel and the winding device into the region above the operating alley. This prevents the thread from being brought by a single operator in the operating alley and in one operation into the first supply device. This detour has to be overcome either by using a relatively complicated, automatic device, or by performance of at least two operating steps by one and the same operator. Furthermore, the first and the third supply device must be located relatively high up, if the operating alley is to be of sufficient height, and the operator is therefore required to thread in the thread into the supply devices in a so-called overhead working position.

Furthermore, an arrangement of this type implies that the fully wound bobbins are carried off through a relatively narrow operating alley. This is rather impracticable and requires adequate care and time.

Accordingly, it is an object of the present invention to provide a false twist machine which makes possible threading in of the thread from a bobbin creel in a single operation in a simple manner and at comfortable operating height while being brought to a winding device via texturing elements.

It is another object of the invention to arrange as large a number of bobbins for a false twist machine at a comfortable operating height above a machine floor such that an exchange of the individual bobbins can be effected without interruption of the production process.

It is another object of the invention to take and carry away fully wound bobbin packages from a false twist machine without impeding the operation required for a texturing process while bringing empty tubes into a reserve position in a simple manner.

It is another object of the invention to provide a compact efficient false twist machine.

It is another object of the invention to provide a creel which is of relatively simple construction for use in a false twist machine.

It is another object of the invention to provide a simple compact winding device for a false twist machine.

Briefly, the invention provides a false twist machine for textile threads or yarn which comprises a creel for a plurality of bobbins, a texturing station, a thread transfer device, and a winding means.

The texturing station has a first supply device for taking in a thread from the creel, a first heat treatment zone located above the first supply device to receive the thread from the first supply device, a cooling zone below the heat treatment zone to cool the thread, a false twist device below the cooling zone for the thread, a second supply device for taking the thread from the false twist device, a second heat treatment zone adjacent the first heat treatment zone to receive the thread from the second supply device, and a third supply device for taking the thread from the second heat treatment zone. The supply devices, false twist device and cooling zone define a texturing part having a back facing the creel and an opposite operating side.

The thread transfer device is located for guiding the thread from the creel into the immediate vicinity of the first supply device.

The winding apparatus is located for receiving the thread from the third supply device and has an operating side facing the operating side of the texturing part in spaced relation to define an operating alley therebetween.

The creel is movable in a direction towards the texturing part and permits the side-by-side arrangement of the creel bobbins. In this manner also, the creel bobbins located next to the texturing part can be exchanged in their bobbin change position without interruption of the production process.

A saving of space and ease of operation of the bobbin creel may be obtained by insuring that a pair of creel bobbins is always adjacent a texturing station. With four superimposed pairs of creel bobbins, four texturing stations can be supplied while the operating height for the bobbin exchange remains comfortable. The width of the bobbin creel may correspond substantially to four times the distance from one texturing position to an adjacent texturing position so that four texturing stations can be supplied. This arrangement is particularly space-saving.

The thread transfer device may advantageously be part of the bobbin creel. In this manner, the thread ends can be clamped in corresponding clamping means as bobbins are supplied to the bobbin creel, and when the bobbin creel is in a bobbin exchange position. Moreover, these thread ends protrude into the texturing station when the bobbin creel is in a working position and are thus presented to the operator in an easy to operate position for taking off and threading in into the elements of the texturing station.

It is advantageous that the thread is taken through the texturing part in a very short path.

The winding apparatus may be arranged to transfer fully wound and relatively heavy bobbin packages in a direction away from the operating side and away from the winding apparatus so that the wound bobbin reaches the outer side of the machine in the shortest way without requiring manual transport. Furthermore, empty bobbin tubes can be moved from outside the machine into the readiness or reserve position within the machine.

These and other objects and advantages of the invention will become more apparent from the following detailed description and appended claims taken in conjunction with the accompanying drawings in which:

Figure 1:
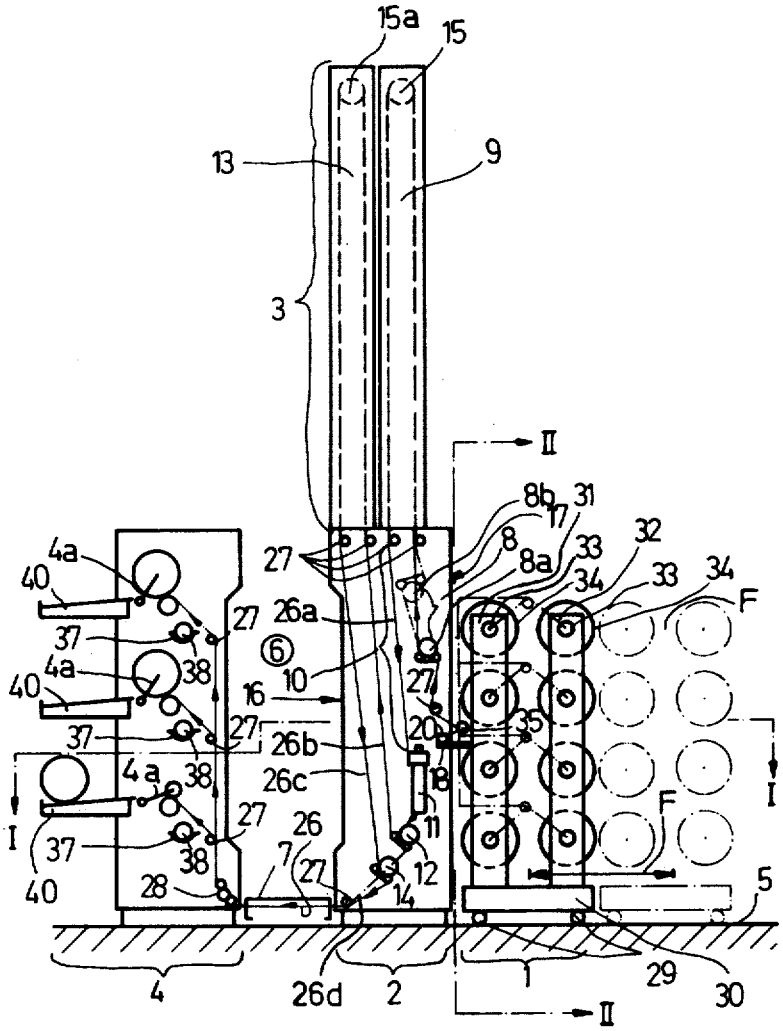
FIG. 1 illustrates a simplified and semi-schematic cross-section of a false twist machine in accordance with the invention.
Figure 2:
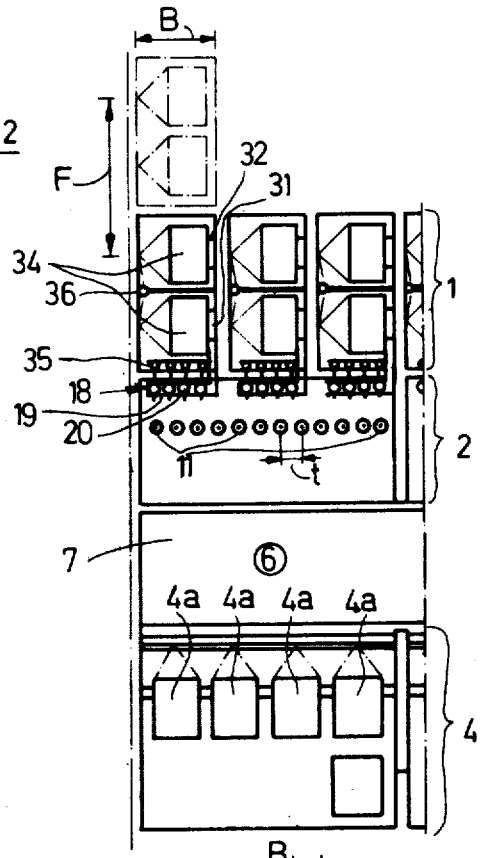
FIG. 2 illustrates a view taken on line I—I of FIG. 1.

Referring to FIGS. 1 and 2, the false twist machine comprises a bobbin creel 1, a texturing part 2, above which heat treatment zones 3 are located and a multi-tiered winding apparatus for facing the texturizing part 2 below the plane of the heat treatment zone 3. The bobbin creel 1, the texturing part 2 and the winding apparatus 4 all are arranged on the same ground floor 5. An operating alley 6 with a walking passage 7 is provided between the texturing part 2 and the winding apparatus 4.

The texturing part 2 and the heat treatment zones 3 together provide a plurality of texturing stations arranged side by side. Each texturing station comprises a first supply device 8, a first heat treatment zone 9 provided as a part of the heat treatment zone 3, a cooling zone 10, a false twist device 11, a second supply device 12, a further, second heat treatment zone 13 provided as part of the heat treatment zone 3 and of a third supply device 14. A thread deflecting device 15, 15' is provided at the upper end of each heat treatment zone 9, 13 respectively.

The texturing part 2 has an operating side 16 facing the operating alley 6 and an opposite back 17.

A thread transfer device or means 18 protrudes from the back 17 into the texturing part 2 (FIG. 1) at about mid-height of the texturing part 2. This thread transfer device 18 comprises a rail 19 (FIGS. 4 and 5) mounted on the bobbin creel 1 (indicated schematically in FIGS. 4 and 5) and thread clamping means 20 therein. The clamping means 20 comprises a knob 21 on which a threaded bolt 23 is mounted and guided in a bore 22 of the rail 19, a limiting nut 24 and a helical spring 25 on the threaded bolt 23 tensioned between the limiting nut 24 and the rail 19.

The thread transfer device 18 may also be mounted on the back 17 of the texturing part 2, rather than on the bobbin creel 1 (not shown). This arrangement may, for example, be chosen, if another type of bobbin creel is used, such as a bobbin creel arranged in a plane above the texturing part.

The first supply device 8 is arranged in the texturing part 2 above the false twist device 11. The second supply device 12 and the third supply device 14 are arranged below the thread transfer device 18 in the sequence mentioned from the top down and from the back to the front, i.e. arranged staggered from the back 17 toward the operating side 16. The arrangement is such that a thread portion 26*a* guided through the cooling zone 10 arranged between the first heat treatment zone 9 and the false twist device 11 is located in front of the first supply device 8, while a thread portion 26*b* is guided from the second supply device 12 into the second heat treatment zone 13 in front of said thread portion 26*a* and the cooling zone 10 respectively. A thread portion 26*c* is also guided from the second heat treatment zone 13 to the third supply device 14 in front of the last mentioned thread portion 26*b*.

The heat treatment zones 9, 13 may have a device, as described in U.S. patent application Ser. No. 844,302, for threading in and placing a thermoplastic thread on a heating device. Using a device of this type, it is possible to transfer a thread to be placed into a heat treatment zone to a mobile thread guide at the lower end of the zone. The mobile thread guide places the thread onto the heating device of the heat treatment zone as the guide lifts the thread the heating device includes a heater and a thread guide at an upper end of the heater for guiding a thread thereover whereby a thread is located on the heater during an approach to the guide and during movement away from the guide.

The heat treatment zones 9, 13 and the supply devices 8, 12 and 14 comprising, for example, a shaft/apron arrangement, correspond to the type of elements generally used for such purposes and are not therefore described in more detail herein. The false twist device 11 may, for example, compare to the false twist device described in U.S. Pat. No. 3,998,041 and comprises a number of friction discs arranged on a shaft with thread guide elements being provided between the friction discs. Furthermore, it is known, that on texturing machines processing an undrawn or a partially drawn thread, the drawing process is also integrated into the whole processing sequence. In such arrangements, simultaneous and sequential drawing are distinct processing possibilities. For the texturing process itself, as well as for the simultaneous drawing process, a shaft/apron arrangement 8*a* is sufficient as a supply device 8, whereas in sequential draw-texturing as shown in FIG. 1, the first supply device 8 comprises the two shaft/apron arrangements 8*a* and 8*b* (indicated with dash-dotted lines) as drawing devices.

Furthermore, the heat treatment after passage through the false twist device 11 can be eliminated if certain types of thread are processed. In an alternative machine of this type, the heat treatment zone 13 and the supply device 14 are eliminated, and the thread, as indicated with the thread portion 26*d*, is transferred directly from the supply device 12 to a thread deflecting device 27 of a type known as such.

Furthermore, the winding apparatus 4 may comprise a superimposed arrangement of winding devices 4*a* of a type known as such, on which the fully wound bobbin packages, as indicated in the lowest winding device tier (also called winder bank), are moved to the outside of the winding apparatus 4, opposite the operating alley 6. For each winder bank, a trough 37 extends along the machine parallel to the operating alley 6 and, emerges at the front of the machine for taking up empty bobbin tubes 38. The empty bobbin tubes 38 are inserted from the front of the machine.

The thread 26, transported through the whole texturing station, is taken in by the third supply device 14 and subsequently is guided via the thread deflecting device 27, which is located below the supply device 14 and lower than the walking passage 7, and is further guided through an oil application apparatus 28 of a type known as such, arranged in the winding device 4 substantially at the same height as the deflecting device 27, and subsequently is guided into the corresponding winding device 4*a* of the winding arrangement.

Instead of using the thread deflecting device 27 after the supply device 12, or 14 respectively, a thread controlling and cutting device (not shown) of a type known as such, can be used. Also, instead of using the oil application device, a device corresponding to the thread deflecting device 27 may be used.

Figure 4:
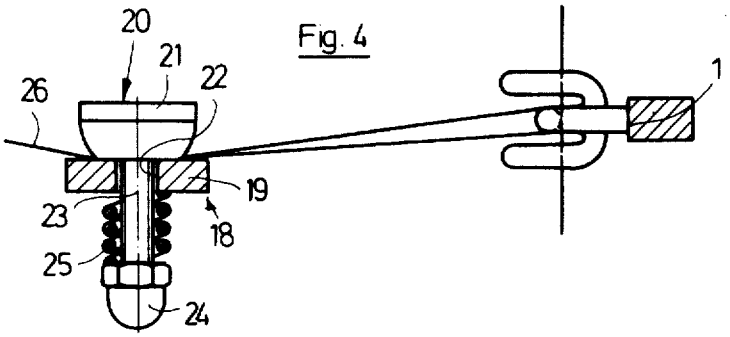
FIG. 4 illustrates a thread transfer device according to the invention in a partial cross-sectional view.
Figure 5:
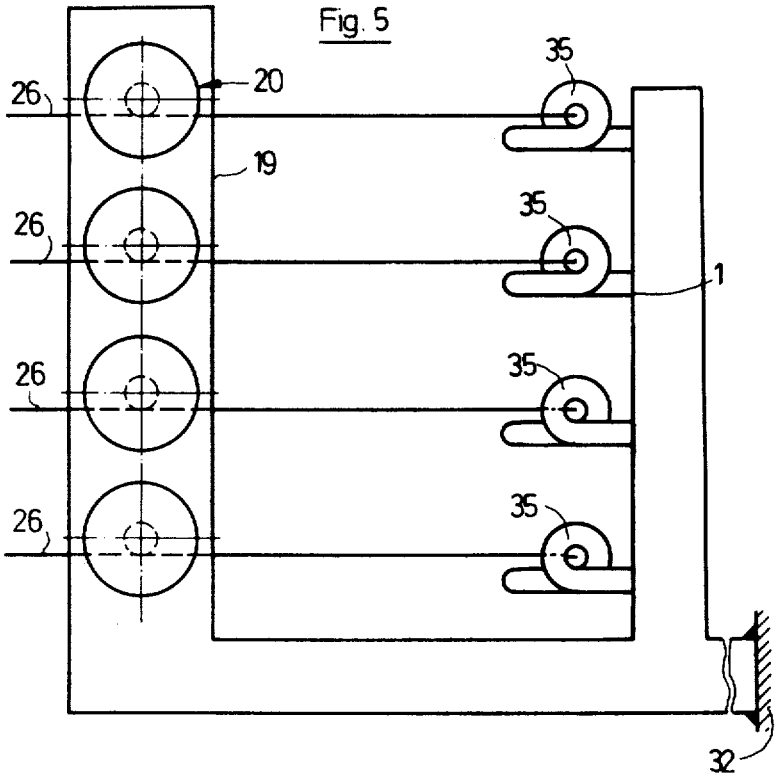
FIG. 5 illustrates a top view of the thread transfer device according to FIG. 4.

The bobbin creel 1 comprises a base plate 30 which is moveable on the ground floor 5 in a direction at right angles (perpendicular) to the texturing part 2 on wheels 29 mounted on the base plate 30. In addition, two support members 31, 32 are vertically arranged on the base plate 30 and are each provided with four bobbin holders 33 (FIGS. 1 and 2) arranged at the same height. The bobbin holders 33 are arranged in such a manner that the rotational axes of creel bobbins 34 thereon extend substantially at right angles to the direction of movement F of the bobbin creel. Two adjacent bobbins placed on the bobbin holders 33 of the same height and spaced in the direction of movement always form a pair of creel bobbins. In this arrangement, the tail end of the creel bobbin package to be unwound is connected in a known manner to the start thread end of the reserve creel bobbin package. The thread 26 to be unwound, i.e. four threads per bobbin creel, is taken off via a device or means described below for continuously taking off a thread alternatingly from two creel bobbins arranged parallel side by side in a creel. Each thread 26 is guided first upward through a thread guide 36 common for both bobbins and is subsequently guided via deflecting means of a type known as such (not shown) into a corresponding pig-tail 35 provided on the side of the bobbin creel 1 facing the texturing part (FIGS. 4 and 5). As shown four pig-tails 35 are provided in horizontal array on each creel 1. Each thread is then subsequently guided into the thread clamping means 20 arranged opposite where the leading end of the thread 26 is clamped and held. Each pig-tail 35 and clamping means 20 thus define a thread transfer means for each take-off means.

The above mentioned device for continuously taking off a thread alternatingly from two creel bobbins arranged parallel in a bobbin creel therefore will not be described. For each pair of bobbins there is a common thread guide 36 and for each bobbin of the pair a thread take-off opening is provided on the extension of the bobbin axis. The leading thread end of the bobbin to be unwound is guided through the coordinated thread take-off opening and then through the thread guide 36 and the deflecting elements mentioned above. Next, the thread is guided through the corresponding pig-tail 35 to the thread clamping means 20 and held clamped until being taken in into the texturing unit. The leading end of the creel bobbin held in reserve is guided, on the one hand, through the thread take-off opening coordinated to this bobbin and, on the other hand, is guided, in the direction towards the bobbin, through the thread take-off opening of the bobbin to be unwound, and is tied to the thread tail end of this bobbin. As the bobbin package is unwound completely, the loop formed by the two tied thread ends glides through the thread take-off opening and the unwinding of the bobbin package held n reserve thus far begins. This sequence repeats itself alternatingly.

Furthermore, the bobbin creels 1 are moved into a bobbin change position indicated in FIGS. 1 and 2 with dash-dotted lines for supplying the bobbin creels 1 with bobbin packages 34 and for guiding the threads 26 to the thread transfer device 18.

The same process is effected if, during operation of the texturing machine, one or a plurality of empty bobbins are to be replaced in a bobbin creel 1. The movement of the bobbin creel 1 is effected, for avoiding undue changes in thread tension between the bobbin 34 and the first supply device 8, at a correspondingly adapted speed.

For starting up the texturing machine, the bobbin creels 1 are moved into their working position after all four threads 26 are clamped and held in the thread transfer device 18, in such a manner that the thread transfer device 18 is brought into the position, mentioned earlier, below the first supply device 8, at a correspondingly adapted speed.

Figure 3:
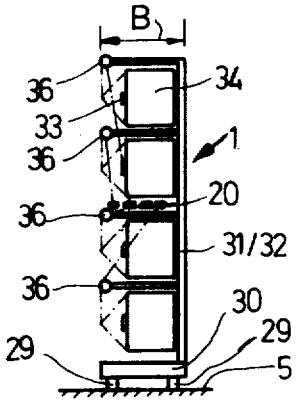
FIG. 3 illustrates a bobbin creel of the false twist machine as viewed from line II—II of FIG. 1.

The width B (FIG. 3) of the bobbin creel 1 corresponds substantially to four times the gauge "t" (FIG. 2). The gauge t in turn corresponds to the distance between two adjacent texturing stations. On the other hand, four winding devices 4*a* arranged side by side correspond substantially to twelve gauges t.

Figure 6:
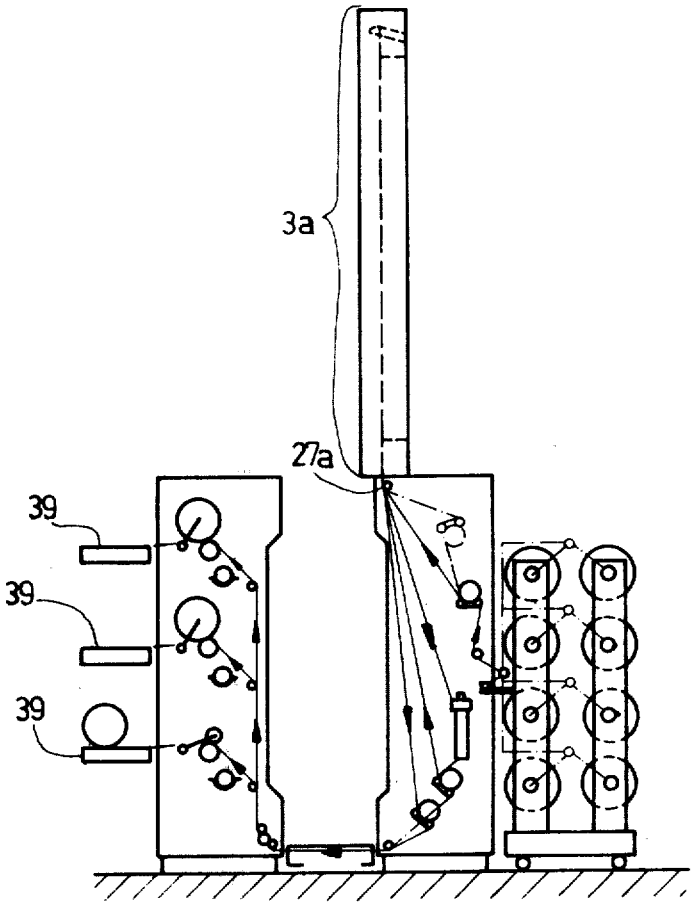
FIG. 6 illustrates an alternative embodiment of a part of the false twist machine according to FIG. 1.

Referring to FIG. 6, the false twise machine may be constructed in an alternative manner. For example, the staggered arrangement of the thread paths 26*a* to 26*c* in front of the thread path between the first supply device and the first heat treatment zone can also be achieved in analoguous manner, if the heat treatment zones are arranged side by side (in longitudinal direction along the machine). This is often used in practical application. In this arrangement, the thread deflecting means 27*a* provided below the heat treatment zones 3*a* are also arranged side by side (not shown) in the longitudinal direction along the machine. All other elements correspond to the elements shown in FIG. 1 and are therefore not designated again. Transporting belts 39 for taking up the full bobbins are used instead of the take-up grids 40 (FIG. 1). If the transporting belts 39 are used, it is possible to dispense with a walking alley for carrying off the full bobbin.

What is claimed is:

1. In a false twist machine for threads, a texturizing station having an operating side comprising a first supply device for taking in a thread;

a first heat treatment zone located above said supply device to receive a thread therefrom;

a cooling zone below said heat treatment zone for the thread;

a false twist device below said cooling zone for imparting a false twist to the thread;

a second supply device for taking up the thread below said false twist device;

a second heat treatment zone adjacent said first heat treatment zone to receive the thread from said second supply device; and a third supply device below said second supply device for taking up the thread from said second heat treatment zone wherein said first supply device, said false twist device, said second and said third supply devices are mutually offset from the top down and toward said operating side.

2. In a false twist machine as set forth in claim 1 which further includes a winding device spaced from said texturing station to define an operating alley therebetween.

3. In a false twist machine as set forth in claim 2 wherein said winding device includes a plurality of winding devices arranged in a plurality of superimposed winding banks, a trough associated with each winding bank for taking up empty bobbin tubes inserted at one end of said trough, and take up means for full bobbins associated with each winding bank.

* * * * *